United States Patent [19]

Vinas

[11] 4,099,390

[45] Jul. 11, 1978

[54] SELECTION DEVICE FOR THE NEEDLES OF A KNITTING MACHINE

[75] Inventor: Juan Vinas, Middle Village, N.Y.

[73] Assignee: Vinatex Knitting Systems, Inc., Brooklyn, N.Y.

[21] Appl. No.: 711,105

[22] Filed: Aug. 2, 1976

Related U.S. Application Data

[63] Continuation-in-part of Ser. No. 520,417, Nov. 4, 1974, abandoned.

[51] Int. Cl.[2] ..... D04B 15/78; D04B 15/74

[52] U.S. Cl. ..... 66/50 R; 66/50 B

[58] Field of Search ..... 66/50 R, 50 B, 154 A

[56] References Cited

U.S. PATENT DOCUMENTS

| | | | |
|---|---|---|---|
| 1,927,016 | 9/1933 | Adler et al. | 66/50 R X |
| 1,972,044 | 8/1934 | Honie | 66/50 R |
| 2,974,506 | 3/1961 | Lanson | 66/42 X |
| 3,449,928 | 6/1969 | Schmidt et al. | 66/50 R |
| 3,667,254 | 6/1972 | Paepice | 66/50 R |
| 3,724,240 | 4/1973 | Flad | 66/50 B X |
| 3,733,855 | 5/1973 | Bliss-Hill et al. | 66/50 R |
| 3,780,540 | 12/1973 | Maidens et al. | 66/50 B |
| 3,896,639 | 7/1975 | Christiansen et al. | 66/50 R |
| 3,955,380 | 5/1976 | Piccino et al. | 66/50 R |
| 3,961,501 | 6/1976 | Martinetz | 66/154 A |
| 3,972,207 | 8/1976 | Vinas | 66/50 R |
| 3,977,215 | 8/1976 | Orobitg | 66/50 R |
| 3,995,451 | 12/1976 | Vinnemann | 66/50 R |
| 3,998,073 | 12/1976 | Luth | 66/50 R |

FOREIGN PATENT DOCUMENTS

| | | | |
|---|---|---|---|
| 2,115,332 | 10/1972 | Fed. Rep. of Germany | 66/50 R |
| 2,159,984 | 6/1973 | Fed. Rep. of Germany | 66/154 A |
| 2,305,427 | 8/1974 | Fed. Rep. of Germany | 66/50 R |
| 1,354,980 | 5/1974 | United Kingdom | 66/50 R |

*Primary Examiner*—Wm. Carter Reynolds
*Attorney, Agent, or Firm*—Friedman, Goodman & Teitelbaum

[57] ABSTRACT

Electrically actuated jack selectors for a knitting machine which are normally positioned out of engagement with the needle jacks or pattern jacks of the knitting machine. When each of the jack selectors is actuated, either by a perforated tape loop or by a drum, the jack selector is deflected into a position along the path of an associated needle jack or pattern jack and, upon engagement therewith, displaces the associated jack relative to the cylinder so that, depending upon the direction of deflection of the jack selector, either the needle jack or the pattern jack will not be raised by the cylinder cam. Each jack selector includes a knife edge cam portion that is engaged by a conically shaped tip on the movable armature of a solenoid that is associated therewith. A comb-like element may be used to initially position a group of the jack selectors in order to predetermine the direction of deflection thereof. The teeth of the comb-like element, between which the jack selectors are positioned, also limit the angular deflection of the jack selectors.

18 Claims, 18 Drawing Figures

SELECTION DEVICE FOR THE NEEDLES OF A KNITTING MACHINE

CROSS REFERENCE TO RELATED APPLICATION

This application is a continuation-in-part of Ser. No. 520,417 filed on Nov. 4, 1974 now U.S. Pat. No. 3,972,207. The aforementioned application is incorporated herein by reference.

BACKGROUND OF THE INVENTION

The present invention relates generally to needle selection devices for knitting machines and more specifically to a selection device that is electrically actuated and which is programmable by a selection tape or the like.

Although the selection device of the present invention may be used with any type of knitting machine, the present selection device was specifically invented for a circular knitting machine such as model KIM made by Masriera S. A., Malgrat de Mar (Barcelona), Spain, a description of which was printed in KNITTING TIMES — May 27, 1974 and KNITTING INTERNATIONAL — June, 1974. The KIM machine, which has a rotating dial and cylinder and a stationary cambox and yarn stand, is presently being made in 10 inch and 12 inch diameters with four feeds, preferrably having 280 needles. Virtually all of the functions of the machine are controlled from a main control chain which works with a series of microswitches, one for each of the 24 functions of the machine. The machine is provided with four feeder knitting stations. A pattern drum for controlling the needle selection is disposed at each feeder station on the machine. The pattern drum contains 24 slots around its circumference and can either take 24 clavettes in each of the slots or individually placed pegs, also 24 high. the clavettes or pegs coact with 24 selectors at each feed, which in turn select the jacks mounted in the cylinder of the knitting machine so as to position associated needles that are required for the knitting process to provide a predetermined knitting pattern.

The predetermined knitting pattern of the KIM knitting machine is limited in size, both in length and width. Since the pattern drum contains 24 steps, the pattern area is either 24 or 49 wales wide depending on whether the 24 step needle jacks that are working in conjunction with the drum are set out in a diagonal formation or a V-formation. The depth of the design is 96 courses with the 24 slot drum. Therefore, if a larger predetermined knitting pattern is desired, the pattern drum must be made larger to contain more slots around its circumference and its vertical length must be increased to provide a greater number of steps for each slot. It is evident that increasing the size of the pattern drum requires that the size of the knitting machine itself be greatly increased.

The cylinder of the KIM machine is provided with alternating needles and pattern elements about its circumference. Pattern jacks are provided beneath both the needles and the pattern elements and the selection process for both the needles and the pattern elements is essentially the same. Selection of the knitting elements is made by the use of jacks in a conventional manner. At the exit of a previous feeding station, the needles and the jacks are cammed down by cams acting on the needle butts. The jacks are disposed within slots around the circumference of the cylinder and may either be pulled out of their associated slots so that their butts protrude or may be pushed in so that their butts lie within their slots. Accordingly, only the non-selected needles have their jacks left protruding from the needle cylinder. The jacks which remain protruding are raised by a cam which raises the corresponding needle or pattern element into the operating position within its slot. Needle selection within the cylinder is carried out by a pattern mechanism which acts on the above-mentioned jacks. The pattern mechanism, which is provided at each feed station, comprises two drums having removable pins. One of the drums is relatively large and has 24 racks or slots. The large drum controls the needle selection for the patterning sequence. The relatively smaller drum, which has 18 slots, controls the needles during the formation of the rib cuffs, etc. The pattern mechanism is arranged so that a pin that is placed in the relatively large pattern drum will push in the jack to cause a needle not to knit to thereby obtain a desired knitting pattern. However, a pin placed in the relatively small drum overrides the pattern drum and causes the needles not to knit regardless of the larger drum. Thus, the larger drum can be used to control the needle selection for the body design whereas the smaller drum is used primarily to select needles for knitting cuffs.

A recently patented example of a prior art knitting selection arrangement for a knitting machine is disclosed in U.s. Pat. No. 3,961,501, granted on June 8, 1976 to Johann Martinetz. The structure disclosed in the Martinetz patent relates to needle selecting arrangements for knitting machines of the type wherein the needle selection is effected by energizing or de-energizing control members that are comprised of materials which undergo dimensional changes, for example, piezoelectric, electrostrictive, magnetostrictive, or bimetallic control members and the like. A cam position control arrangement in the Martinetz patent includes at least one cam position control member that is comprised of one of the foregoing materials that is capable of undergoing dimensional changes. Upon the application of an energizing signal to the control member, the control member undergoes a dimensional change thereby causing the control member to control the position of the selecting cam arrangment. In the Martinetz structure, a plurality of elongated force-transmitting members may be included with one being provided for each motion transmitting portion. Control cams are mounted for movement relative to the carrier, or vice-versa and are operative for effecting longitudinal movement of the force transmitting member to a position causing respective motion-transmitting members to assume one of their respective positions. A biasing spring urges the force-transmitting member back in the opposite direction and a detent that may also be made of a piezoelectric material is energizable or de-energizable in order to assume a position locking the force transmitting member in the activated position thereof against the returning force of the biasing spring.

The piezoelectric structure in the Martinetz patent can be shaped and positioned so as to effect a needle selecting operation utilizing the characteristic of the piezoelectric materials which permits it to be alternately activated and de-activated with very high frequency. However, one of the disadvantages of the piezoelectric material is that the actual force that it can directly bring to bear is not great, compared to the force which can be exerted by an electromechanical relay. In the Martinetz patent this obvious and well known limitation of the piezoelectric material is overcome by exploiting the combined action of a plurality of such piezoelectric control members and/or by making use of such control members in needle selecting arrangements where the control members are not called upon to create the actual force which moves the motion-imparting portions of the needle units into engagement with the lifting and lowering cams. Another substantial disadvantage of the use of piezoelectric materials is that the extent of the dimensional change or deflection thereof is not accurately controlled either in magnitude or direction.

SUMMARY OF THE INVENTION

The present invention provides an improved needle selection device which can be easily programmed and remotely and electrically controlled. The increased versatility of the present invention permits the manufacture of a great range of patterns in a simple and economical manner. More specifically, the present invention utilizes electrically actuated jack selectors which are normally positioned so as to be out of contact or engagement with the needle or pattern element jacks. When actuated by either a tape or a drum, the jack selector is deflected either upwardly or downwardly into a position within the path of an associated needle jack or pattern jack, and, upon engagement, urges the jack into a position relative to the cylinder so that the jack is not raised by the cam. A punch tape loop may be used in conjunction with stationary detecting or "reading" means for detecting the perforations in the tape. When a perforation or hole is detected, a signal is generated which is used to actuate or deflect the associated jack selector by means of a solenoid, for example.

One feature of the present invention resides in the use of a knife edge on each of the jack selectors. The knife edges are arranged to cooperate with the tapered or pointed end of the armature of an associated solenoid so that the tapered or pointed end of the armature acts as a cam follower surface.

Cooperating with the jack selectors of the present invention is a comb-like element, between the teeth of which are positioned the jack selectors. Initially the comb is positioned either just above or just below the pointed or tapered tips of the armatures of the solenoids. When a particular solenoid is energized, the armature thereof moves forwardly and engages the knife edge cam portion of one of the jack selectors which then rides up the tapered surface of the armature and is thereby deflected either upwardly or downwardly. The edges of the teeth of the comb-like member also define the limits of deflection of the jack selector. Since the position of the comb-like element and the actuation of the solenoids can be done electrically and remotely, the present invention lends itself to programming for complex patterns and special knitting effects.

Accordingly, it is an object of the present invention to provide an improved needle selection device for a knitting machine.

It is another object of the present invention to provide a needle selection device for a knitting machine, as described above, that is electrically operated.

Yet another object of the present invention is to provide a needle selection device for a knitting machine, as described above, that may be remotely operated.

Yet another object of the present invention is to provide an improved needle selection device for a knitting machine that may be electronically programmed by a selection tape or drum.

A further object of the present invention is to provide an improved needle selection device for a knitting machine wherein the selector jacks are mechanically deflected in either of two opposite directions, such as by a tapered end of an armature of a solenoid for each jack which coacts on a knife edge of the associated jack.

Still another object of the present invention is to provide an improved needle selection device for a knitting machine wherein means are included for limiting the deflection of the selector jacks, such as a comb-like element.

A further object of the present invention is to provide an improved needle selection device for a knitting machine wherein the selector jacks are afforded a maximum deflection with a minimum force being applied thereto.

BRIEF DESCRIPTION OF THE DRAWINGS

With the above and additional objects and advantages in view, as will hereinafter appear, this invention comprises the devices, combinations, and arrangements of parts hereinafter described by way of example and illustrated in the accompanying drawings of a preferred embodiment, in which.

DESCRIPTION OF THE PREFERRED EMBODIMENT

Figure 1:
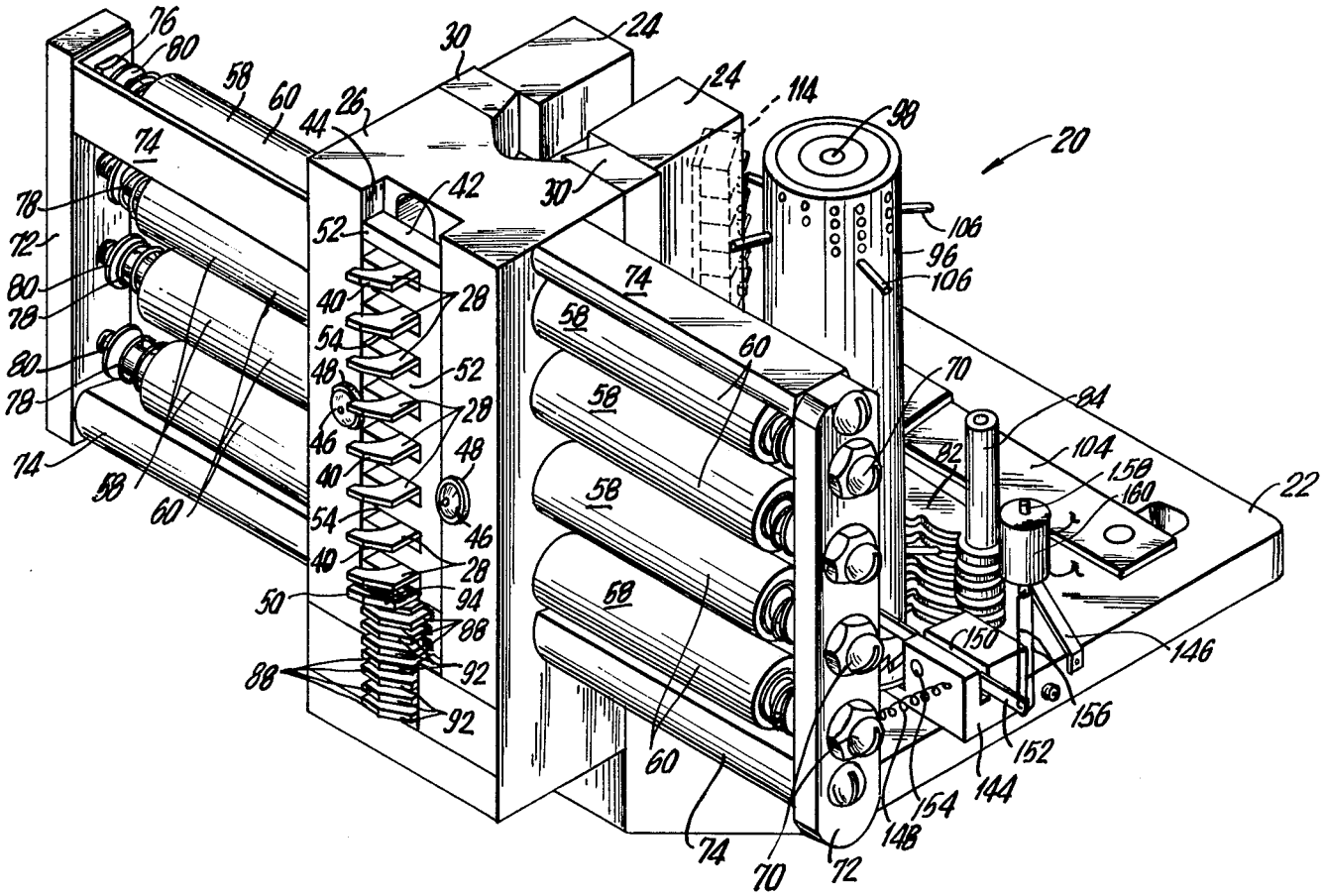
FIG. 1 is a perspective view of the improved needle selection device for a knitting machine comprising the present invention.
Figure 2:
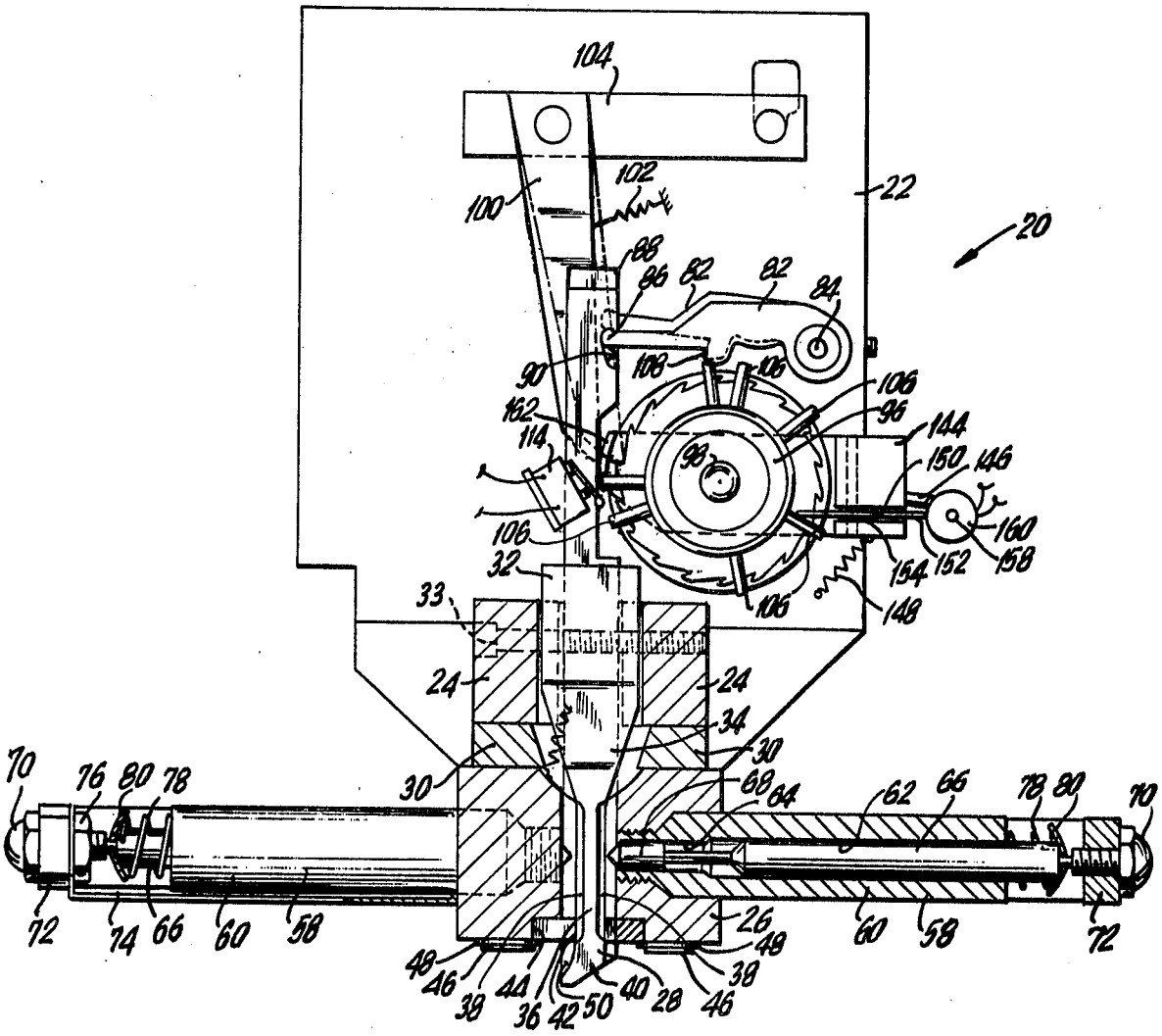
FIG. 2 is a top plan view, partially in section and partially schematic, illustrating the structure shown in FIG. 1.
Figure 3:
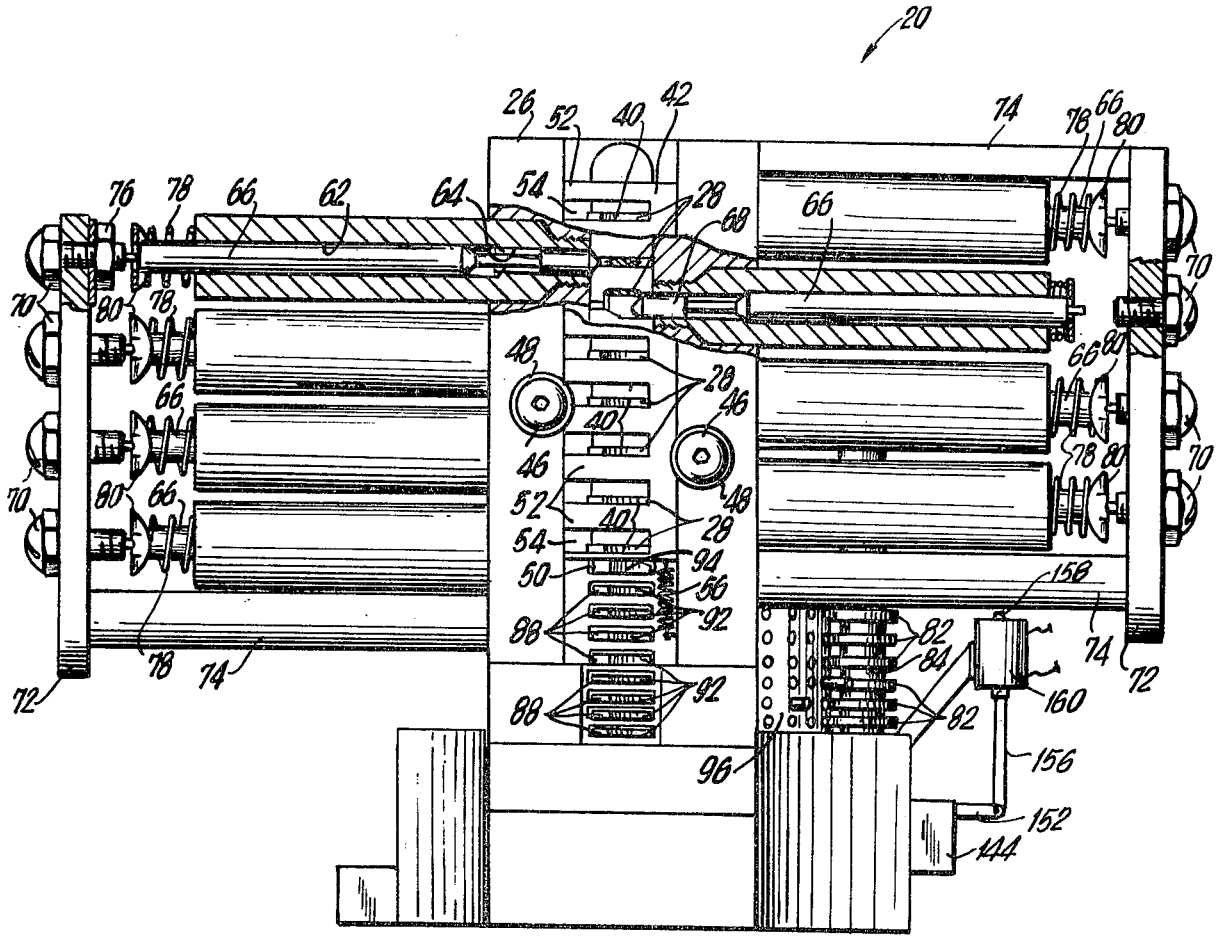
FIG. 3 is a front elevational view, partially in section and partially schematic, illustrating the comb-like member shown in FIG. 1 and FIG. 2 in a first position.

Referring now to the drawings, and particularly to FIGS. 1–3, there is shown an improved needle selection device 20 comprising the present invention. The device 20 includes a base member 22 having a pair of posts 24 extending upwardly therefrom, the posts 24 being secured to the base member 22 in a conventional manner. An upright support housing 26 and a pair of spacer members 30 are secured in any suitable manner to the forward end of the posts 24.

A first set of deflectable jack selectors 28 are stacked one above the other such that the jack selectors 28 are spaced apart from each other in a vertical direction and extend through the posts 24, the spacer members 30 and the support housing 26, such as shown in FIG. 2 for example. Each jack selector 28 includes a relatively rigid base or mounting portion 32 which is secured between the posts 24 by tightening a threaded bolt 33 to provide a press-fit therebetween. A tapered, flexible, resilient portion 34 is reduced in both thickness and width with respect to the base portion 32 and is integral therewith at one end. The other end of the tapered portion 34 is integral with a relatively thin section 36 having a knife-edge or substantially V-shaped cam 38 formed along each side edge thereof, and a cam surface 40 formed on the deflectable end portion thereof. It will be noted, particularly in FIG. 2, that even though the portion 36 of the uppermost jack selector 28 has a knife-edge cam 38 that faces in both directions, only alternate knife-edge cams 38 are utilized in the operation thereof, as will be explained below. The double knife-edge cam 38 is formed to simplify the manufacture thereof, so that the jack selectors 28 are interchangeable. In any event, the jack selectors 28 are normally in a relaxed or non-flexed condition, and in such a condition are positioned to pass between the jack butts and, therefore, will not engage the jack butts as set forth below.

As will be described more fully hereinafter, the jack selectors 28 may be deflected so as to come into the path of the jack butts to prevent one or more of the needles from knitting in order to achieve a desired pattern.

Slidably mounted on the front face of the upright support housing 26 is a comb-like member 42 that cooperates with the jack selectors 28. The comb 42 is received in a suitably shaped, sized and positioned slot 44 in the front face of the upright support housing 26 and is retained by means of screws and washers 46 and 48, respectively. It will be appreciated that the screws 46 and washers 48 can be utilized to either permanently position the comb 42 or can be loosened and then retightened after the vertical position of the comb 42 has been changed in order to meet special requirements. Alternatively, the screws 46 can pass directly through the comb 42 and into the upright support housing 26 providing that vertically oriented slots are formed in the comb 42 in order to permit vertical adjustment thereof in the same manner.

Figure 8:
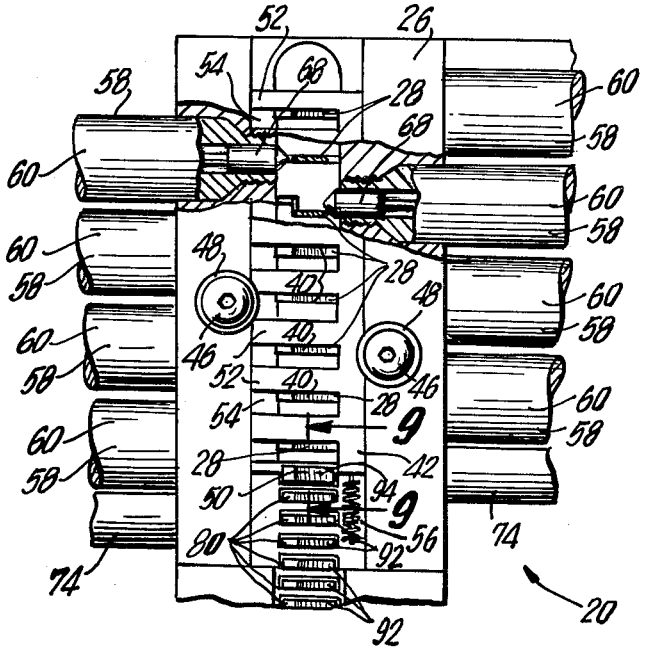
FIG. 8 is a fragmentary front elevational view, partially in section, illustrating the comb-like member in an alternate second position.

In still another alternative preferred embodiment, the screws 46 and the washers 48 are used merely to retain the comb 42 in the groove 44 but not to prevent the vertical movement thereof. In this last mentioned embodiment, a comb positioning selector 50 is utilized to automatically move the comb 42 upwardly from the position shown in FIG. 8 to the position shown in FIGS. 1 and 3, as will be described below.

Figure 4:
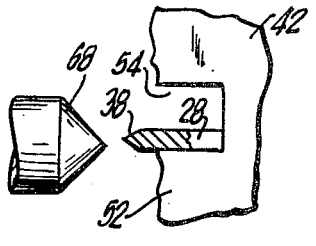
FIGS. 4 and 5 are schematic, fragmentary elevational views illustrating the relationship between the armature tip and the knife edge of the jack selector when the comb-like element is in the raised position.
Figure 6:
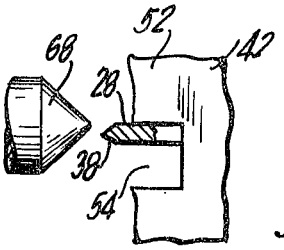
FIGS. 6 and 7 are schematic, fragmentary elevational views similar to FIGS. 4 and 5 illustrating the components when the comb-like element is in the lowered position.

The comb 42 includes a plurality of spaced teeth 52 with nine teeth being shown in order to form eight spaces or slots 54. Each of the slots 54 is arranged to accept an associated jack selector 28 between the two opposite surfaces of adjacent teeth 52. The comb 42 is positioned as closely as possible to the camming tip 40 of each jack selector 28 in order to provide the greatest mechanical advantage for bending the flexible portion 34 thereof, relative to the rigidly secured end 32 of the jack selectors 28. The comb-like member 42 is moveable in a plane that is substantially perpendicular to the parallel planes of the jack selectors 28. It will be evident that movement of the comb 42 in either an upward or downward direction will cause one of the two opposite surfaces of each adjacent teeth 52 to engage one of the jack selectors 28 and cause the slight bending thereof in the same direction as the movement of the comb 42. That is, if the comb 42 is moved upwardly as shown in FIG. 4, the jack selectors 28 are bent slightly upwardly while if the comb 42 is moved downwardly as shown in FIG. 6, the jack selectors 28 are also moved slightly downwardly. A return spring 56 is connected under tension between the base 22 and the comb 42 in order to return the comb 42 to its initial lower position when the comb 42 is automatically actuated as set forth below.

A plurality of electromagnets in the form of solenoids 58 are mounted on the upright support housing 26. The solenoids 58 are threaded into the upright support housing 26 as shown for example in FIG. 2 and in FIG. 3. Since the body 60 of the solenoids 58 are dimensioned larger than the spacing between the jack selectors 28, successively higher solenoids 58 are alternately mounted on opposite sides of the jack selectors 28 as shown best in FIG. 3. It is because of the alternate mounting of the solenoids 58 that only alternating ones of the knife edge cams 38 of the jack selectors 28 are utilized as previously described.

The body 60 of each solenoid 58 has a large bore 62 at the outer end thereof and a relatively smaller bore 64 at the inner end thereof. A tapered shoulder connects the large and small bores 62 and 64, respectively. An armature or plunger 66 is contained within each solenoid body 60 and is relatively slideable therein along the axes of the bores 62 and 64. Each plunger 66 is shaped to substantially correspond to the shape of the bores 62 and 64 and for this purpose is provided with a relatively large diameter within the bore 62 and a relatively small diameter within the bore 64. The small diameter of the plunger 66 terminates in an enlarged tapered deflector head or cam follower 68 which may be conical, tapered or V-shaped.

The plungers 66 are prevented from moving outwardly of the body 60 of the solenoid 58 by the retaining action of a screw 70 which is threaded into a bracket 72. Standoffs 74 support the brackets 72 on the upright support housing 26. A nut 76 is utilized to adjust the position of the standoff 74. In addition, the plungers 66 are biased by means of compression springs 78 which act between the end surface of the body 60 of the solenoid 58 and a cup-shaped washer 80 which is integral with the screw 70. When the plungers 66 are fully retracted, with the springs 78 relaxed, the deflector head or cam follower 68 is almost fully contained within the small bore 64 so that the tapered deflector head or cam follower 68 does not engage the jack selectors 28, as shown in FIGS. 2, 3, 4, 6 and 8.

The comb 42 is initially adjusted so that the action of the comb positioning selector 50 will cause the comb 42 to position the knife edge cams 38 of the jack selectors 28 just above, as shown in FIG. 4, or just below, as shown in FIG. 6, the pointed tips of the deflector heads or cam followers 68. Since both the knife edge cam 38 and the deflector head or cam follower 68 each, advantageously, have sharp, confronting edges, the deflection necessary for the comb 42 to either raise or lower the knife edge cams 38 relative to the tips of the deflector head 68 is minimal, as shown in a comparison of FIG. 4 to FIG. 6, and is insufficient to cause the jack selectors 28 to engage the jack butt, mentioned below.

Figure 5:
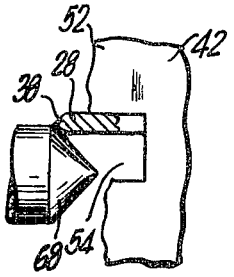
Figure 7:
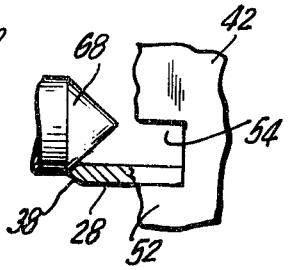

However, when a solenoid 58 is energized, the deflector head or cam follower 68 associated therewith will move inwardly and will engage an associated knife edge cam 38, so that the knife cam 38 either rides up the tapered surface of the deflector head 68 as shown in FIG. 5, or down the opposite tapered surface of the deflector head 68 as shown in FIG. 7, depending upon in which direction the comb 42 is positioned, which is determined upon whether or not it is desired to actuate the needle jacks or the pattern jacks, where the engagement of the knife edge cam 38 with the deflector head or cam follower 68 brings the camming surface 40 of the associated jack selector 28 into the path of the jack butt, as set forth below. When the comb 42 is in its upper position as shown in FIG. 4 to thereby slightly raise the jack selectors 28, it will be evident that actuation of the solenoids 58 will cause the jack selectors 28 to be further deflected upwardly, as shown in FIG. 5, to engage the butt of the pattern jack. On the other hand, when the comb 42 is in its lower position as shown in FIG. 6, the cams 38 of the jack selectors 28 are slightly below the deflector heads or cam followers 68, and energization of the solenoids 58 results in a further downward deflection of the jack selectors 28 as shown in FIG. 7, which thereby permits engagement with the butt of a needle jack.

As mentioned hereinabove, once the direction of deflection has been determined, the comb 42 can be positioned in place by means of the comb positioning selector 50. When the desired position of the comb 42 has been achieved, it will be appreciated that the teeth 52 thereof define the initial and final limits of deflection of the jack selectors 28. It is noted that the tension or force of the spring 56 on the comb 42 is greater than the force of the deflection by the solenoids 58 on the jack selectors 28 so that the deflection does not cause any movement of the comb 42. Furthermore, the resilient spring force of the jack selectors 28 acting on the tapered surface of the heads 68, as shown in FIGS. 5 and 7, tends to aid the return of the plungers 66 to the fully retracted positon so that the required spring force of the springs 78 can be minimized.

Since the position of the comb 42 and the actuation of selected ones of the solenoids 58 can be electrically and remotely controlled, the selection device 20 comprising the present invention can be programmed for complex patterns and special knitting effects. The manner of programming may take the form of a punched tape and a cooperating tape reading device as described in the application Ser. No. 520,417 co-pending herewith now U.S. Pat. No. 3,972,207, or punched cards or other equivalent structure may be utilized.

In order to achieve the special knitting effects, it is sometimes desirable to "inhibit" the operation of the jack selectors 28. As with conventional drums, it is possible to override the action of the jack selectors 28 by acting on lower butts of the jacks. For this purpose, a plurality of pivotable levers 82 are mounted on a common pin or shaft 84 as shown in FIG. 2. Each of the levers 82 is coupled at one end 86 thereof to the comb operating selector 50 or to a jack selector 88 of a second lower set of selectors, each being provided with a suitable notch 90 for this purpose. Spring means 56 is utilized to restore the comb operating selector 50 and the jack selectors 88 to the jack engaging positions. The jack selectors 88 which each have a non-deflectable body and a cam surface 92, and comb operating selector 50 having a cam surface 94, are actuated to the non-engaging position by means of a rotatable drum 96 having a ratchet wheel that is mounted on a shaft 98 in a vertical position. The ratchet wheel of the drum 96 rotated in a stepwise manner by the conventional knitting machine advancing mechanism that includes a pawl 100, a pawl spring 102 and an actuating arm 104 that is suitably mounted on the base 22, where it is noted that the pawl 100 can be actuated by a solenoid in a conventional manner.

The drum 96 is provided with a plurality of radially extending pins 106 about the circumference thereof and at various levels or different heights that correspond to the planes of the levers 82. When a pin 106 engages a projection 108 formed on the lever 82 intermediate the pivot axis and the end thereof that is in engagement with one of the selectors 50, 88, the lever 82 will be pivoted in a clockwise direction as viewed in FIGS. 2 and 17 to thereby move the selector 50, 88 associated therewith away from a position near the knitting machine cylinder to avoid camming against a jack as set forth below.

While not specifically illustrated, the selectors 50, 88 can also be manually moved out of the jack engaging positions by rotating a drum pre-selector which is provided with a plurality of pins at different vertical heights corresponding to each of the levers 82. When one of the pins engages its associated lever 82, the lever will again be turned in a clockwise direction just as if the lever 82 was engaged by a pin 106. Thus, the manual pre-selector may serve as a permanent override of the programmed drum 96, so that the drum 96 will only actuate the levers which are not engaged or cancelled by the pre-programmed manual pre-selector.

Figure 9:
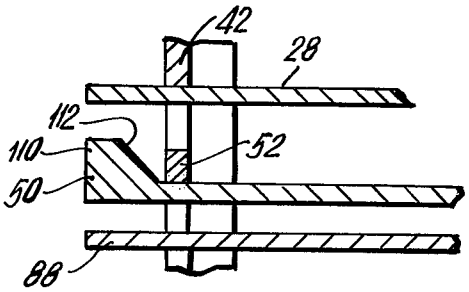
FIG. 9 is a fragmentary side elevational view illustrating means for displacing the comb-like member.
Figure 10:
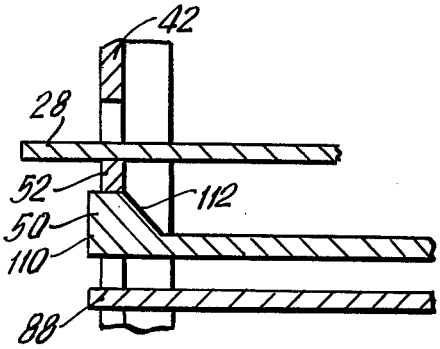
FIG. 10 is a sectional side elevational view similar to FIG. 9 illustrating an alternative position of the components thereof.
Figure 17:
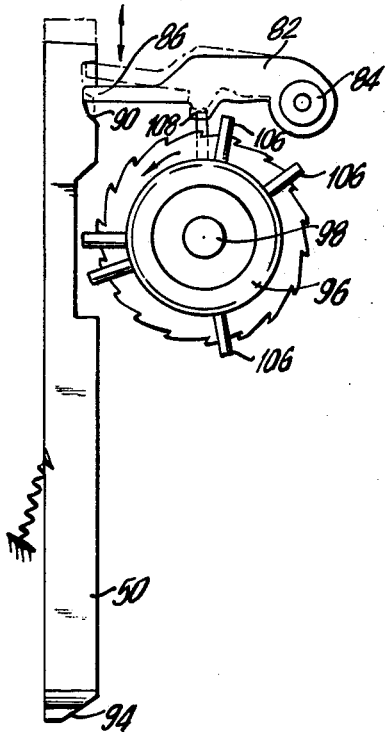
FIG. 17 is a top plan view schematically illustrating further means for displacing the comb-like member.

As indicated in the drawings, the comb operating selector 50 is similar to the jack selectors 88 except for an enlarged tip portion 110 on the selector 50, shown in FIGS. 9 and 10, having a sloping or inclined upper cam surface 112. When the projection 108 on the lever 82 that is in opposition to the cam operating selector 50 is engaged by one of the pins 106 on the drum 96 as shown in FIG. 17, the cam operating selector 50 will move from the position shown in FIG. 9 to the right, as shown in FIG. 10, and the camming surface 112 thereof will drive the bottom tooth 52 of the comb 42 in an upward direction to position the comb 42 in its raised position. Accordingly, depending upon the pin placement, another lever 82 may engage a jack selector 88 by action of an associated pin 106 to move the jack selector 88 from the jack engaging position shown in FIG. 9 to the right, as shown in FIG. 10, so that the jack selector 88 cannot engage its associated jack. It is noted, as will be described below, the cam operating selector 50 also engages the jacks when in the left position shown in FIG. 9.

The needle selection device 20 is also provided with a plurality of vertically stacked interrupter microswitches 114, which are arranged to be actuated by the pins 106 at various vertical heights or levels on the drum 96 in order to start, change, disable or "inhibit" the operation of the jack selectors 28, as required, such as when a special knitting effect is desired. One example of such a special knitting effect is the making of cuffs.

In the embodiment illustrated there are eight jack selectors 28, directly therebelow there being provided the cam operating selector 50, and then a group of eight jack selectors 88 spaced one above the other. The eight lowest ones of the jack selectors 88 are utilized to act on the needles to make cuffs etc. by acting on the lower butts of the needle jacks. The upright support housing 26 receives the jack selectors 88 and includes horizontal means for guiding each of the jack selectors 88 so that the jack selectors 88 may respond to either the action of the drum 96 or to the manual preselector described hereinabove.

For a clearer understanding of the present invention, the structure and function of the jacks of the knitting machine will now be briefly described, however reference should be made to co-pending patent Ser. No. 520,417 now U.S. Pat. No. 3,972,207 for a fuller description thereof. The jacks of the present invention are arranged in sets, there being eight different needle jacks and eight different pattern jacks in each set, where the needle jacks are utilized to move associated conventional needles to their operating position in the cylinder of the knitting machine. The pattern jacks (transfer jacks) are utilized to move associated conventional pattern or transfer elements in the cylinder to their operating position, where both the needles and transfer elements operate in a conventional well known manner so that discussion thereof is not necessary, being well known in the art.

Figure 11:
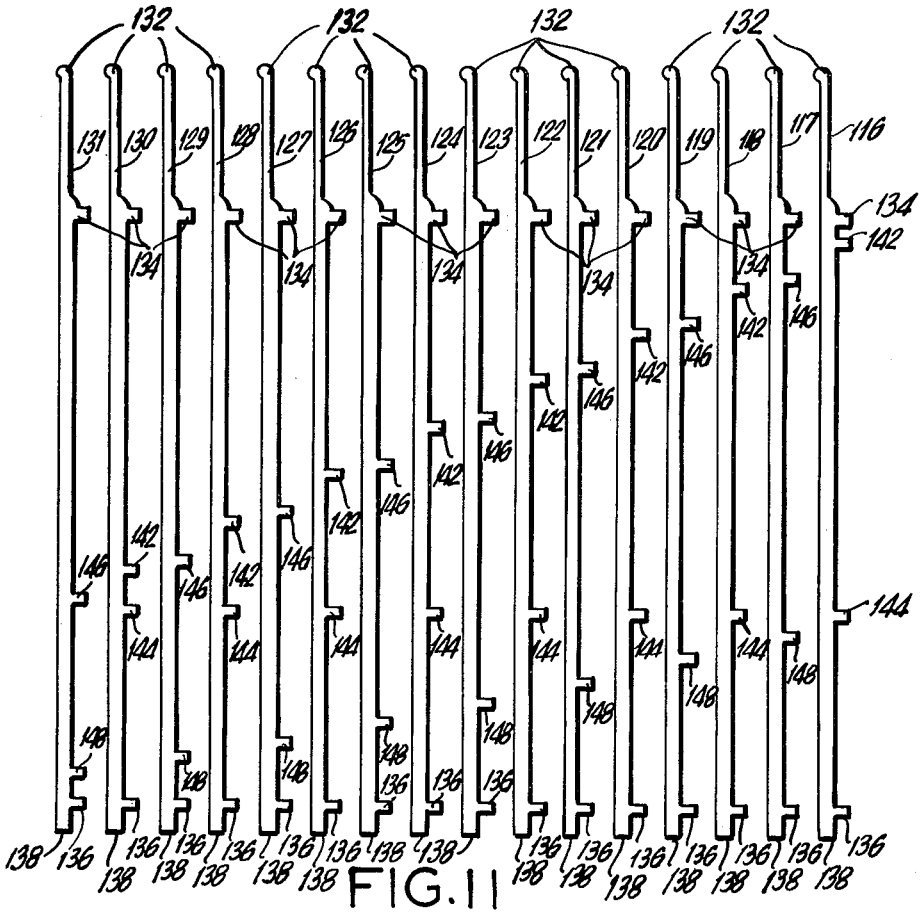
FIG. 11 is a side elevational view of a set of needle and pattern jacks of the present invention.
Figure 12:
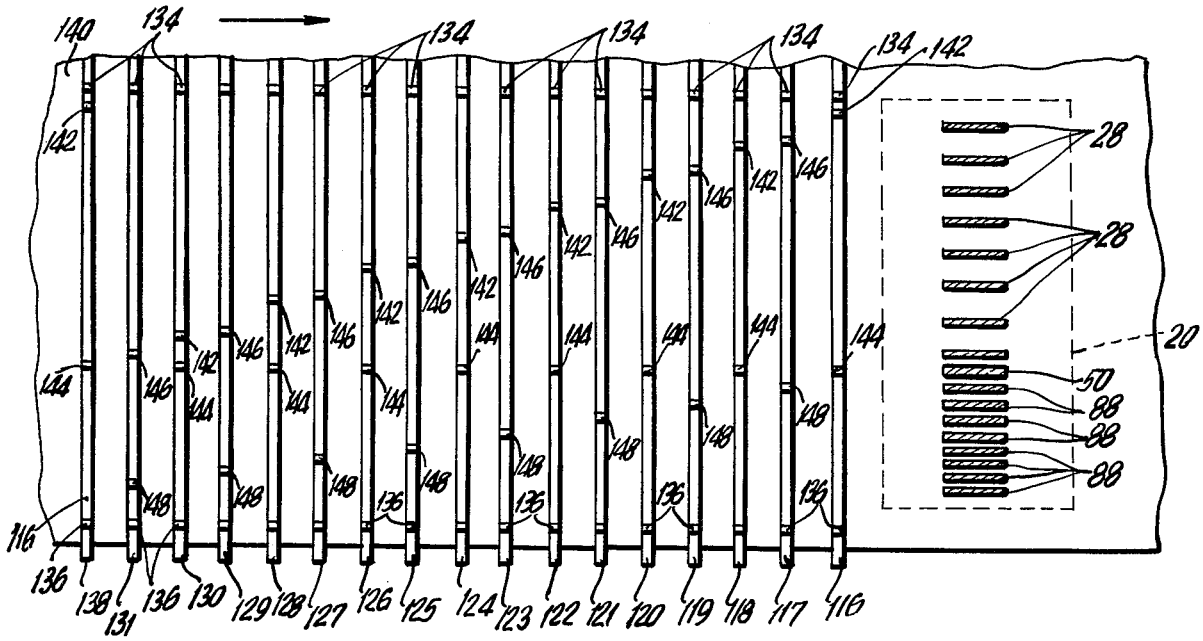
FIG. 12 is a schematic, fragmentary elevational view illustrating the arrangement of the selectors relative to the needle and pattern jacks mounted in the cylinder of the knitting machine.

As shown in FIGS. 11 and 12, the pattern jacks 116, 118, 120, 122, 124, 126, 128 and 130 are alternated with the needle jacks 117, 119, 121, 123, 125, 127, 129 and 131 so that there is a needle jack between every pair of pattern jacks, and vice-versa. As shown in FIG. 12, pattern jack 116 of the next set, shown at the left side, consecutively follows the needle jack 131 of the previous set, and so on completely around the circumference of the knitting machine cylinder 140.

Each of the needle and pattern jacks has a pivot end portion 132 and a cam engaging butt or tab 134 adjacent to the end 132, where the tab 134 functions to lower the jacks in a conventional manner after the knitting operation. A second cam engaging butt or tab 136 is adjacent to the opposite end 138 of each of the needle and pattern jacks, where the tab 136 functions to raise the jacks in a conventional manner to abut against the needles and transfer elements to raise the needle and transfer elements to their operating position. Additionally, each transfer jack is provided with an upper butt or tab 142 for engagement with the jack selectors 28, and a lower butt or tab 144 for engagement with the cam operating selector 50. Each needle jack is provided with an upper butt or tab 146 for engagement with the jack selector 28, and a lower butt or tab 148 for engagement with the jack selectors 88. As shown in the drawings, the tabs 142, 146 and 148 are disposed in a diagonal or inclined arrangement, it being understood that any other suitable arrangement may also be utilized, where the tabs 144 on the pattern jacks are arranged in a straight horizontal arrangement, which will be discussed below.

FIG. 12 shows a fragmented illustration of the arrangement of the selectors 28, 50, and 88 relative to the needle and pattern jacks 116–131, where certain parts have been omitted for a simplier presentation thereof, such as the needles, the transfer elements, the slots in the cylinder 140, in addition to some of the needle and transfer jacks. As shown, selectors 28, 50 and 88 are disposed one above each other so that in this arrangement, a particular selector 28, 88 can only be associated with every sixteenth abutment tab on the jacks for example, selector 28 at the top of the stack is only associated with abutment tabs 142 on the jacks 116.

However, the cam positioning selector 50 is associated with abutment tab 144 on each of the pattern jacks. Therefore, when the cam positioning selector 50 is in the inward position shown in FIG. 9, all the pattern jacks will be moved into their respective slots by the selector 50 and therefore will not be raised so that the transfer elements will not function. It is noted, in this position, the comb 42 is in the lower position so that the selectors 28 can only engage the needle jacks. Thus, as shown above, when the needle jacks are being acted upon by the selectors 28, the transfer elements will not function.

It is noted, that when the selectors 28 are in their relaxed positions or substantially non-deflected, as shown in FIG. 12, the camming surfaces 40 thereof will pass between the jack butts 142, 146 of the pattern and needle jacks respectively, so that the jacks remain outside of the slots of the cylinder for subsequent camming of the butts 136. However, each of the selectors 50, 88 is in line with their associated butts 144, 148 so that the selectors 50, 88 must be retracted from the cylinder 140 by means of the above-mentioned levers 82 in order to avoid engaging these butts.

Figure 13:
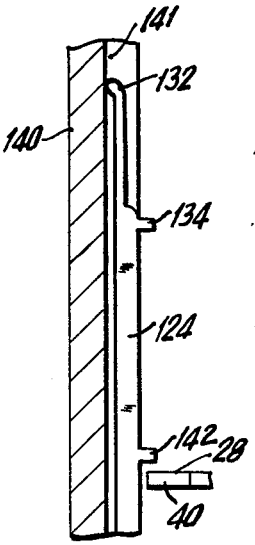
FIGS. 13 and 14 are schematic, fragmentary elevational views illustrating the relationship between the needle selection device of the present invention and a pattern jack.
Figure 14:
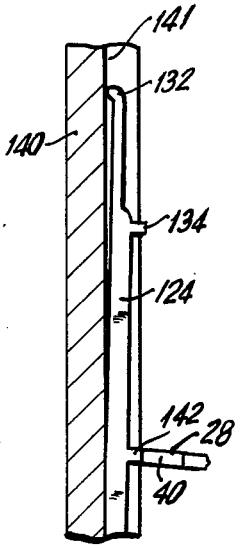

FIG. 13 illustrates the relaxed position of the selector 28 relative to the butt 142 of the pattern jack 124 disposed in the slot 141 of the cylinder 140. FIG. 14 illustrates the upwardly deflected selector 28 having its cam surface 40 engaging and pushing the butt 142 into the slot 141 so that this pattern jack 124 will not be raised for activation of its associated transfer element.

Figure 15:
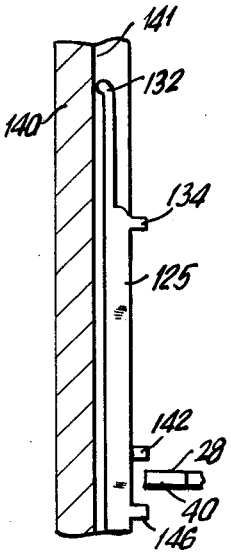
FIGS. 15 and 16 are fragmentary elevational views in section, similar to FIG. 13 and FIG. 14, illustrating the relationship of the needle selection device of the present invention with respect to a needle jack.
Figure 16:
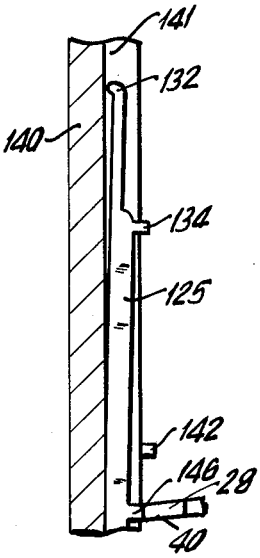

FIG. 15 illustrates the relaxed position of the selector 28 relative to the butt 146 of the needle jack 125 disposed in the slot 141 of the cylinder 140. FIG. 16 illustrates the downwardly deflected selector 28 having its cam surface 40 engaging and pushing the butt 146 into the slot 141 so that this needle jack 125 will not be raised for activation of its associated needle element. Thus, when a selected one of the jack selectors 28 is deflected, the camming surface 40 thereof is placed within the path of the associated, advancing jack butt, and upon engagement therewith, the jack is urged into the slot 141 of the cylinder 140.

Figure 18:
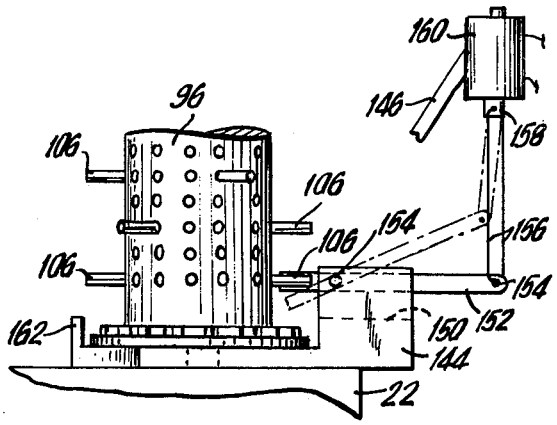
FIG. 18 is a fragmentary elevational view, partially schematic, illustrating structure for stopping the apparatus.

In normal operation, a tape loop as disclosed in copending application Ser. No. 520,417 now U.S. Pat. No. 3,972,207 will control the movement of the selectors 28, during which time a conventional counter (not shown) counts the rows of knitting in a usual manner well known in the art. After a predetermined number of rows have been knitted, the counter activates the arm 104 of the conventional advancing mechanism so that the drum 96 is rotated by the pawl 100 acting on the ratchet wheel of the drum 96. As the drum 96 rotates, a pin 106 thereof engages one of the microswitches 114, the microswitches 114 activates a conventional mechanism which stops and rewinds the tape loop, whereby the selectors 28 are no longer deflected. The drum 96 continues to rotate so that the additional pins 106 contact the levers 82 to either retract the selectors 88 in the engaged position or to release the selectors 88 in the non-engaged position of the levers 82 so that the selectors 88 can contact the butts 148 on the needle jacks. Accordingly, once the selectors 88 have been positioned by the levers 82 acted upon by a selected number of pins 106, it is desired to stop the drum 96 to maintain the selected positions of the selectors 88. Accordingly, the structure for stopping the drum 96 is best illustrated in FIG. 18.

This stopping mechanism is conventional, being used in knitting machines having similar drums, so that a brief description thereof should be sufficient. The stopping mechanism includes a block 144 suitably mounted on the base 22 for rotation about the pin 98, being positioned beneath the drum 96. The block is spring biased by a spring 148 and is provided with a slot 150. An arm 152 is pivotally mounted in the slot 150 by means of a pin 154. The arm 152 is connected at 154 by a wire loop 156 to the armature 158 of a solenoid 160. The solenoid is supported by a bracket 146 secured to the base 22. An upwardly projecting tab 162 is disposed on the opposite side of the block 144.

In operation, a pin 106 on the drum 96 engages the arm 152 and rotates the block 144 therewith until the projecting tab 162 is disposed between the pawl 100 and the ratchet wheel of the drum 96. Thus, the tab 162 prevents the pawl 100 from turning the drum 96 and therefore the drum stops in its selected position.

The knitting machine continues to knit the pattern selected by the selectors 88, such as in the making of a cuff or border. A second conventional counter well known in the art, counts the rows of knitting in the cuff, and at a predetermined number, the counter activates the solenoid 160 in a conventional manner well known in the art. The armature 158 of the activated solenoid 160 pulls up on the wire loop 156 so that the tip of the arm 152 is pivoted away from its associated pin 106, whereby the spring 148 returns the block to its original position as the drum 96 continues to rotate due to the removal of the tab 162 from between the pawl 100 and the ratchet wheel of the drum 96. At this point, another pin 106 engages another microswitch 114 to start the tape loop and to stop the motion of the drum 96, so that the needles of the knitting machine can continue to knit according to the pattern determined by the selectors 28.

From the foregoing it will be appreciated that the camming action of the deflector head or cam follower of the solenoids, in cooperation with the knife edge portion of the automatic jack selectors assures maximum deflection of the jack selectors with a minimum of force being applied. Moreover, the deflection of the jack selectors is accurate, controllable and predetermined. The comb-like member, that may be utilized in combination with the jack selectors, may be fixed or may be movable and determines the direction of deflection of the automatic jack selectors which may be either in the upward direction or the downward direction.

Numerous alterations of the structure herein disclosed will suggest themselves to those skilled in the art. However, it is to be understood that the present disclosure relates to a preferred embodiment of the invention which is for purposes of illustration only and is not to be construed as limitations of the invention.

What is claimed is:

1. A selection device for knitting machines having a rotating cylinder with slots around its circumference for accommodating knitting needles and associated needle jacks therein, said device comprising:

(a) a plurality of jack selector means each having a deflectable end portion and cam means spaced from a free end of said deflectable portion and integral therewith;

(b) support means for positioning said jack selector means relative to the cylinder whereby said free end of each said jack selector means operatively coacts with associated needle jacks;

(c) actuator means for deflecting selected ones of said jack selector means in accordance with a predetermined program, said actuator means including cam follower means for engaging said cam means and thereby deflecting said deflectable end portion of said jack selector means in a direction whereby the needle jack associated therewith is engaged and displaced; and (d) means for changing said direction of deflecting said deflectable end portion including a comb-like member having a plurality of teeth defining comb slots therebetween, said deflectable end portion of each said jack selector means extending through said comb slots and being disposed against either of two opposite surfaces of adjacent teeth.

2. A selection device according to claim 1, wherein said cam means are substantially V-shaped to provide two surfaces positioned relative to said cam follower means such that said cam follower means engages one of said two surfaces of said cam means.

3. A selection device according to claim 1, wherein said comb-like member is moveable in a plane that is substantially perpendicular to parallel planes of said jack selector means.

4. A selection device according to claim 1, wherein said two opposite surfaces of adjacent teeth define means for limiting the deflection of each said jack selector means.

5. A selection device according to claim 1, wherein means are included for moving said comb-like member between first and second positions, one of said two opposite surfaces contacting said jack selector means in said first position, and the other of said two opposite surfaces contacting said jack selector means in said second position.

6. A selection device according to claim 1 including a second plurality of jack selector means each having a non-deflectable body and a cam surface for engaging and displacing different portions of the needle jacks than said first-mentioned jack selector means.

7. A selection device for knitting machines having a rotating cylinder with slots around its circumference for accommodating knitting needles and associated needle jacks therein and for accommodating pattern jacks therein in an alternating arrangement with the needle jacks, said device comprising:

(a) a plurality of jack selector means each having a deflectable end portion and cam means spaced from a free end of said deflectable portion and integral therewith;

(b) support means for positioning said jack selector means relative to the cylinder whereby said free end of each said jack selector means operatively coacts with associated needle jacks when deflected in a first direction and operatively coacts with associated pattern jacks when deflected in a second direction;

(c) actuator means for deflecting selected ones of said jack selector means in accordance with a predetermined program, said actuator means including cam follower means for engaging said cam means and thereby deflecting said deflectable end portion of said jack selector means in one of said first and second directions, said jack selector means engaging and displacing said needle jacks when deflected in said first direction and engaging and displacing said pattern jacks when deflected in said second direction; and (d) means for changing the direction of deflecting said deflectable end portion from said first direction to said second direction.

8. A selection device according to claim 7, wherein a separate one of said actuator means is provided for each of said jack selector means.

9. A selection device according to claim 8, wherein each said actuator means is an electromagnet and its said cam follower means is integral with a moveable portion thereof.

10. A selection device according to claim 8, wherein said jack selector means are stacked in a vertically spaced apart array, said actuator means for adjacent ones of said jack selector means being alternately located on opposite sides thereof for association with respective ones of said cam means.

11. A selection device according to claim 7, wherein said cam follower means includes sloping surface means that defines an end of reduced thickness as compared to the remainder thereof, whereby said reduced thickness end is arranged to engage said cam means.

12. A selection device according to claim 7, wherein each of said jack selector means further includes a rigid mounting portion at an opposite end thereof that is remote from said cam means.

13. A selection device according to claim 7, wherein said jack selector means further includes a cam surface that is arranged to selectively engage a butt portion of a needle jack in accordance with the predetermined program.

14. A selection device according to claim 7, wherein said means for changing said direction includes a comb-like member having a plurality of teeth defining comb slots therebetween, said deflectable end portion of each said jack selector means extending through said comb slots and being disposed against either of two opposite surfaces of adjacent teeth.

15. A selection device according to claim 14, wherein said two opposite surfaces of adjacent teeth define means for limiting the deflection of each said jack selector means.

16. A selection device according to claim 14, wherein means are included for moving said comb-like member between first and second positions, one of said two opposite surfaces contacting said jack selector means in said first position, and the other of said two opposite surfaces contacting said jack selector means in said second position.

17. A selection device according to claim 16, wherein said means for moving said comb-like member includes a cam surface for engaging a butt on the pattern jacks when the needle jacks are in operation in order to stop operation of the pattern jacks.

18. A selection device according to claim 7 including a second plurality of jack selector means each having a non-deflectable body and a cam surface for engaging and displacing different portions of the needle jacks than said first-mentioned jack selector means.

* * * * *